United States Patent [19]

Shibata

[11] 4,243,413

[45] Jan. 6, 1981

[54] INTEGRATED AG-SNO ALLOY ELECTRICAL CONTACT MATERIALS

[75] Inventor: Akira Shibata, Yokohama, Japan

[73] Assignee: Chugai Denki Kogyo Kabushiki-Kaisha, Japan

[21] Appl. No.: 14,915

[22] Filed: Feb. 26, 1979

Related U.S. Application Data

[63] Continuation-in-part of Ser. No. 807,910, Jun. 20, 1977, abandoned.

[51] Int. Cl.[3] ..... B22F 3/00; C22C 1/05; C22C 29/00

[52] U.S. Cl. ..... 75/234; 75/206; 75/236

[58] Field of Search ..... 75/234, 236, 206, 137 A

[56] References Cited

U.S. PATENT DOCUMENTS

| | | | |
|---|---|---|---|
| 3,933,485 | 1/1976 | Shibata | 75/173 A |
| 3,989,516 | 11/1976 | Haarbye | 75/173 A |
| 4,112,197 | 9/1978 | Metz | 428/673 |

OTHER PUBLICATIONS

Hirschorn, *Introduction to Powder Metallurgy,* APMI 1969, pp. 238–242.

*Primary Examiner*—Brooks H. Hunt
*Attorney, Agent, or Firm*—Shlesinger, Fitzsimmons & Shlesinger

[57] ABSTRACT

Ag-SnO alloy contact materials of such dimensions which are hard to achieve internal oxidation without producing depleted cores due to lack of tin oxides, are produced by metallurgically integrating pieces of said alloy material, said pieces being of such dimensions that they are easily internally oxidized without any depleted cores. Integration consists of congregating or assembling said pieces by kneading under pressure and at a temperature higher than 700° C. into a mass in which said pieces coalesce to each other without any distinctive silver interface thereamong, and through which tin oxides are uniformly dispersed substantially without any grain boundaries.

5 Claims, 2 Drawing Figures

INTEGRATED AG-SNO ALLOY ELECTRICAL CONTACT MATERIALS

Figure 1:
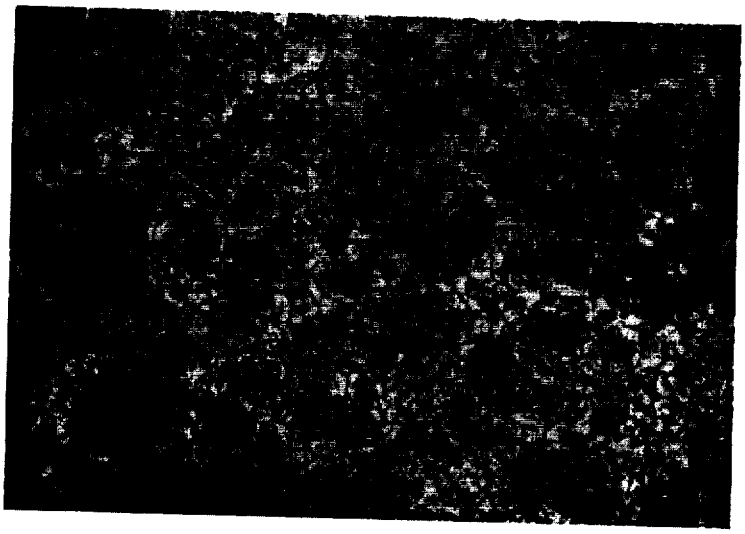

This is a continuation-in-part application of my pending U.S. Patent application, Ser. No. 807,910 filed June 20, 1977 now abandoned.

This invention relates to an integrated electrical contact material, and more particularly, it relates to an electrical contact material integrated from Ag-SnO alloy piece materials. This invention is also related to a method of producing this material, and also a composite electrical contact made therewith.

Ag-SnO alloy contact materials made by internal oxidation were disclosed by the present inventor, for example in U.S. Letters Pat. No. 3,933,485. Those alloys, which have metal oxides precipitated therein as the result of internal oxidation, are composed of 1.5–10% by weight of tin, 0.5–6% by weight of indium, a trace amount of less than 0.5% by weight of iron family element metals, and the balance of silver, and are advantageously utilizable in the present invention. Those alloys have, besides tin oxides which are precipitated dispersedly within silver grain matrices, those tin oxides which are precipitated concentratedly along silver grain boundaries in a tortoise-shell pattern, for example. Such tortoise-shell patterned silver grain boundaries are inevitably produced when an alloy contains more than 0.5% of tin.

It has been affirmed by the present inventor through a number of experiments that Ag-SnO alloys are comparable with or superior to Ag-CdO alloys in their various characteristics. But, the former has the drawback in the manufacturing thereof that the diffusion velocity of oxygen for the internal oxidation of Ag-Sn alloys (for example, oxygen diffusion into the internal alloy structures under an atmospheric condition of about 700° C.) is comparatively slower than that for Ag-Cd, viz., about half of the latter's. This means that it takes a considerably long period of time to have Ag-Sn alloy of comparatively large dimensions internally oxidized, and that the internal oxidation of such alloy is sometimes incomplete and produces depleted cores in which tin oxides scarcely exist.

In order to overcome such drawbacks which are somewhat inherent to Ag-SnO alloys, and also in order to obtain advantageously Ag-SnO alloy contact material of comparatively large dimensions, the inventor has made this invention, in which a number of pieces of Ag-SnO alloys (Ag-Sn1.5–10%-In0.5–6% -Ni or Co less than 0.5%), each having dimensions which enable each piece to be completely internally oxidized in a comparatively short period of time, and which pieces are, for example, in the shape of thin plates, wires, or granules, are congregated or assembled together under pressure into a desired mass or shape, and are heated at a temperature of about the melting point of silver, viz., 960° C.

This integration step can be performed also be congregating said number of Ag-SnO alloy pieces with silver, copper, or alloys thereof, whereby it is possible to produce composite contact materials having large dimensions or mass, and being composed of said silver, copper or their alloys, which are clad with Ag-SnO alloy materials. When copper is utilized as a base for the integrated material of this invention, said heat-treatment temperature shall preferably be about the eutectic temperature of silver and copper, viz., 779° C.

The electrical contact material thus obtained and integrated from Ag-SnO alloy pieces or materials, with our without a base portion of silver, copper or their alloys, may be subjected to heat-rolling or extrusion so as to shape the contact material to a plate or wire of desired dimensions. In this instance, the aforementioned heat-treatment under the melting point of silver would be conducted together with said rolling or extrusion.

It has been found from durability tests that the integrated Ag-SnO alloy electrical contact made in accordance with this invention is superior, especially with respect to its contact resistance, to the corresponding Ag-SnO alloy contact which is internally oxidized solidly as a unit, when the contacts have comparatively large dimensions. This is because, when a Ag-SnO alloy of relatively large dimensions is internally oxidized primarily as a whole, the internal oxidation becomes incomplete, as aforementioned, resulting in making its inner portion less hard, while its contact pressure decreases along with wear of the contact, whereby contact resistance thereof becomes large, resulting in undesirable welding thereof. On the contrary, the novel contact disclosed herein has no such phenomena, since it has even hardness throughout its mass and life partly on account of non-existence of depleted zones or cores. And, this is partly because of congregation or assembly of the pieces by kneading or extrusion under pressure and at a temperature higher than 700° C., which allows the silver matrices of each piece to be wet and soften to metallurgically coalesce to each other without any interfaces therebetween, and which allows the tin oxides, particularly those which are concentratedly precipitated along the aforementioned tortoise-shell patterned silver grain boundaries, to intermingle or intermigrate freely to any softened silver matrices, thereby causing said silver grain boundaries to disappear, and consequently resulting in making the tin oxide particles disperse very uniformly and evenly throughout the integrated silver pieces or silver matrices.

Working principles on which this invention has been made are enumerated as follows:

(1) Metal oxides of the Ag-SnO having the aforementioned compositions are stable above 700° C. and even above the melting point of silver, 960° C. Since CdO in Ag-CdO alloys such as described in U.S. Pat. No. 3,989,516 sublimes at about 725° C., and starts to decompose at a temperature far lower than that, such alloys can not be subjected to the integration process of this invention, because the CdO would be reduced to pure Cd.

(2) Metal oxides precipitated in said Ag-SnO alloy are far harder than those of Ag-CdO alloy, and are about one tenth of the latter in size. Hence, they and their dispersion phases within the alloy structures remain the same even after rolling or extrusion thereof. In addition, these extremely minute and hard metal oxides work to prevent congregated alloy pieces from sliding relative to each other when they are subjected to pressure, whereby their fresh abutting surfaces are kept fresh and active. This effect is noticeable especially when the present invention integrated material is made with copper as a base thereof; and (3) Stresses produced in the integrated Ag-SnO alloy materials are relieved with a rolling or extrusion operation, since the operation can be held at a temperature about the partial melting point of silver. This is also on account of the discontinuation of silver grain boundaries within alloy structures, produced with hot-rolling or extrusion.

This invention is described in more detail hereinafter in the following examples, and in conjunction with the accompanying drawing.

Figure 2:
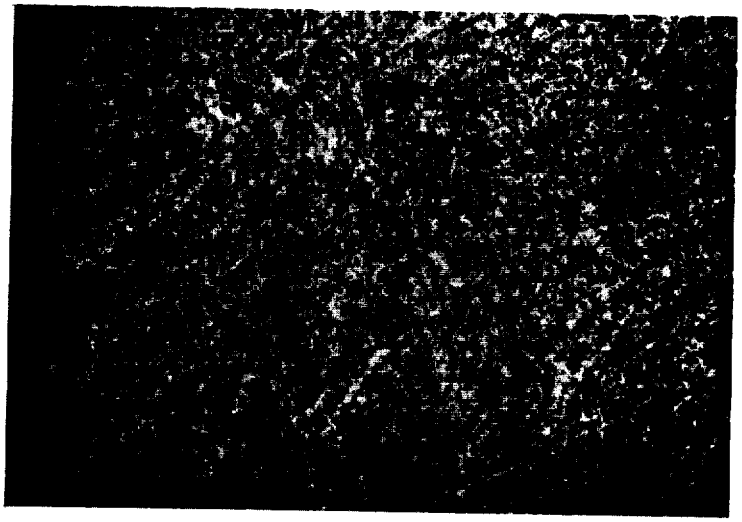

In the drawing:

FIG. 1 is a microphotograph (X100) of a short wire of Example 2 which was subjected to an internal oxidation at 3 atm. of oxygen and at the temperature of 700° C. for 20 hours, and FIG. 2 is a microphotograph (X100) of one of six pieces of wire of 4 mm. diameter which were obtained after a hot extrusion at 800° C.

EXAMPLE 1

An alloy of Ag-Sn5%-In1.7%-Ni0.3% (in weight) was rolled to a plate of 1 mm in thickness. The plate was cut to small plates of 60 mm in width and 300 mm in length. The small plates were subjected to an internal oxidation at 10 oxidizing atm. and at the temperature of 700° C. for 40 hours. Both surfaces of the small plates thus internally oxidized were cleaned by 5% nitric acid solution.

A piece of silver plate of the same size as said small plates, and ten pieces of said Ag-SnO small plates were placed one above the other in layers, the silver plate being the bottom-most layer. These assembled or congregated plates were heated at the temperature of 800° C. for 10 minutes, while they were kept under a pressure of 1 ton/cm$^2$. The plates integrated in this manner to a mass were preheated to 800° C. and rolled to a plate of 2 mm in thickness, from which contacts of 6 mm diameter were punched out. Said contacts of the present invention, and other contacts of the same size and composition which were internally oxidized as a unit at said size, were tested regarding their performances as prescribed in A.S.T.M.

Test conditions were as follows:

| | |
|---|---|
| Voltage A.C.: | 220V |
| Current: | 50 amps |
| Load: | reactor P+ =0.2 |
| Frequency: | 60 times per minute |
| Switching cycles: | 100,000 |
| Contact resistance: | 100 g |

Results were as follows:

| | Present Invention Ag—SnO alloy contact | Normally oxidized Ag—SnO alloy contact |
|---|---|---|
| Welding (times) | 7 | 8 |
| Contact pressure | 2.0mΩ | 3.5mΩ |
| Wear Loss | 23mg | 25mg |

EXAMPLE 2

An alloy of the composition as in Example 1 was processed to a wire of 2 mm in diameter. This wire was cut into short wires of 300 mm in length. The short wires were subjected to an internal oxidation at 3 atm. of oxygen and at the temperature of 700° C. for 20 hours. Their resultant internally oxidized structures are as shown in FIG. 1. After washing them with an acid they were assembled or congregated into a bundle 50 mm in diameter. This bundle was subjected to a hot extrusion at the temperature of 800° C., whereby six pieces of wire of 4 mm in diameter were obtained. Their resultant structures are as shown in FIG. 2. These wires were processed to form a tape of 0.5 mm in thickness and 4 mm in width, while being repeatedly subjected to annealing. To one of the surfaces of this tape a different tape of the same dimensions, and composed of Cu-Ni (30%) alloy, was press joined, while the tapes were heated to a temperature of about 850° C. The abutting surfaces had eutectic structures which assured a strong joint.

The tape-shaped Ag-SnO alloy contact material thus obtained had better elongation than Ag-SnO alloy contact materials of the type which were conventionally internally oxidized. Contrary to conventionally oxidized Ag-SnO alloy materials, which have poor tensile strength and are apt to have cracks when they are out to a desired length, the present invention products were able to be welded to contact leaves, and they were continuously cut to a predetermined length.

EXAMPLE 3

An alloy of Ag-Sn8%-In3%-Ni0.3% (in weight) was prepared and melted. It was atomized by a blast of nitrogen gas to produce granules of 0.3 to 1.5 mm in diameter. They were subjected to an internal oxidation step in an oxidizing atmosphere and at the temperature of 700° C. for 6 hours. They were washed by an acid and congregated or assembled into the form of a disk of 6 mm in diameter and 2 mm in thickness, with silver powders of one tenth of the total weight being placed at the bottom. This disk-shaped contact was pressed under 3 tons, and then sintered for 3 hours at the temperature of 900° C. and under the flow of oxygen. This product was finally shaped under the pressure of 5 tons.

It was found from tests that said disk-shaped contact made in accordance with the present invention had contact resistances as low as 30 to 50% of conventional ones.

What is claimed is:

1. An electrical contact material of comparatively large dimensions, formed from a plurality of generally similarly shaped pieces of silver-base alloy, which are of such dimensions that they are substantially smaller than the material having said large dimensions, and are such that said pieces are readily and completely internally oxidizable without depleted zones, each of said pieces of silver-base alloy, prior to being formed into said contact material, having silver grain matrices with metal oxides dispersedly precipitated therein, and said matrices being defined by metal oxides concentratedly precipitated along silver grain boundaries arranged generally in a tortoise-shell pattern as the result of internal oxidation for a comparatively short period of time, and comprising 1.5 to 10% by weight of tin, 0.5 to 6% by weight of indium, and a trace amount of less than 0.5% by weight of iron family element metals, and said pieces of the alloy being metallurgically integrated with each other by pressure rolling or extrusion conducted at a temperature higher than 700° C., and at about the melting point of silver, thereby to eliminate said grain boundaries in said pieces by causing precipitated metal oxides to migrate from said boundaries into said grain matrices, and to cause said matrices to coalesce to each other to form said contact material with said metal oxides being distributed uniformly throughout said material.

2. A contact material as claimed in claim 1, wherein said metallurgically integrated pieces of alloy are clad under pressure to a base material selected from the group consisting of powders or plates of silver, copper and alloys thereof.

3. A method of making a Ag-SnO alloy electric contact material of comparatively large dimensions, which comprises providing a desired number of pieces of silver-base alloy of such dimensions that they are internally oxidizable within a comparatively short period of time, each of said pieces comprising 1.5 to 10% by weight of tin, 0.5 to 6% by weight of indium, and a trace amount of less than 0.5% by weight of nickel or cobalt, and internally oxidizing said pieces to form throughout each piece silver grain matrices defined by boundaries created by concentrations of precipitated metal oxides, and metallurgically integrating said pieces to each other by simultaneously subjecting them to extreme pressure at a temperature higher than 700° C. and sufficient to induce at least partially the melting of said pieces of said alloy without decomposing or breaking down the metal oxides precipitated in said pieces, thereby to eliminate the concentrations of said metal oxides around the silver grain matrices in said metallurgically integrated pieces, and to disperse the formerly concentrated metal oxides uniformly throughout the silver matrices of the integrated pieces.

4. The method as claimed in claim 3, in which at least one piece of metal selected from the group consisting of silver, copper and alloys thereof is assembled under pressure with the pieces of the Ag-SnO alloy.

5. The method of making an electrical contact comprising forming a plurality of pieces of an alloy containing 1.5–10% by weight of tin, 0.5–6% by weight of indium, and a trace amount of less than 0.5% by weight of nickel or cobalt, subjecting said pieces to a heat treatment for a brief interval of time to effect substantially complete internal oxidation thereof and consequent precipitation of metal oxides in silver grain matrices in said pieces, at least certain of said precipitated metal oxides being concentrated along silver grain boundaries which border said matrices in each of said pieces, and thereafter metallurgically integrating said internally oxidized pieces, under pressure and a temperature in excess of 700° C., into the configuration of the desired electrical contact without decomposing the metal oxides precipitated in said pieces, and by causing the metal oxides to migrate from the concentrated areas thereof evenly and freely into the integrated silver matrices of the pieces and thus to eliminate the silver grain boundaries in said metallurgically integrated pieces.

* * * * *